United States Patent [19]

Armstrong et al.

[11] 3,955,912

[45] May 11, 1976

[54] TEST PHOTOFLASH LAMP

[75] Inventors: Donald E. Armstrong, Williamsport, Pa.; Thomas B. McDonough, Fremont, N.H.; John W. Shaffer, Williamsport; Ronald E. Sindlinger, Muncy, both of Pa.

[73] Assignee: GTE Sylvania Incorporated, Montoursville, Pa.

[22] Filed: May 31, 1974

[21] Appl. No.: 475,348

[52] U.S. Cl. ..... 431/95 R; 431/93

[51] Int. Cl.[2] ..... F21K 5/02

[58] Field of Search ..... 431/93–95, 431/95 A

[56] References Cited

UNITED STATES PATENTS

| | | | |
|---|---|---|---|
| 1,995,938 | 3/1935 | Nichols | 431/95 |
| 2,490,769 | 12/1949 | Andrea | 431/95 |
| 2,740,281 | 4/1956 | Honing et al. | 431/95 |
| 2,816,406 | 12/1957 | Eppig | 431/93 |
| 3,676,663 | 7/1972 | Beare et al. | 431/93 |

*Primary Examiner*—Carroll B. Dority, Jr.
*Attorney, Agent, or Firm*—Edward J. Coleman

[57] ABSTRACT

A photoflash lamp containing a readily ignitable, hydrogen-containing substance, such as shredded paper or a spot of sucrose, to controllably induce bursting of the lamp upon ignition for purposes of testing the relative strength and reliability of lamp containment systems, including the envelope, envelope coatings and flash unit enclosures.

13 Claims, 3 Drawing Figures

TEST PHOTOFLASH LAMP

BACKGROUND OF THE INVENTION

This invention relates to photoflash lamps and, more particularly, to test flashlamps useful for the test and development of lamp containment systems.

A typical photoflash lamp comprises an hermetically sealed glass envelope, a quantity of combustible metal located in the envelope, such as shredded zirconium or hafnium foil, and a combustion supporting gas, such as oxygen, at a pressure well above one atmosphere. In lamps intended for battery operated flash systems, the envelope also includes an electrical ignition system comprising a tungsten filament supported on a pair of lead-in wires having a quantity of ignition paste on the inner ends thereof adjacent to the filament. This type of lamp is operated by the passage of an electrical current through the lead-in wires which incandesces the filament to ignite the ignition paste which in turn ignites the combustible metal in the envelope. In the case of percussive-type photoflash lamps, such as described in U.S. Pat. No. 3,535,063, a mechanical primer is sealed in one end of the lamp envelope. The primer may comprise a metal tube extending from the lamp envelope and a charge of fulminating material on an anvil wire supported in the tube. Operation of the percussive photoflash lamp is initiated by an impact onto the tube to cause deflagration of the fulminating material up through the tube to ignite the combustible metal disposed in the lamp envelope.

During lamp flashing, the glass envelope is subject to severe thermal shock due to hot globules of metal or metal oxide impinging on the walls of the lamp. As a result, cracks and crazes occur in the glass and, at higher internal pressures, containment is a problem. In order to reinforce the glass envelope and improve its containment capability, it has been common practice to apply a protective lacquer coating on the envelope, such as cellulose acetate.

For customer convenience, and in keeping with the miniaturization of popular cameras, flashlamps have evolved to ever-smaller sizes. For example, subminiature flashlamps having an envelope volume of less than one cubic centimeter are presently mass produced in large quantities for use in small photographic flashlamp units referred to as flashcubes. As described in U.S. Pat. No. 3,244,087, electrical flashlamp units of this type comprise: a container having a plurality of closed transparent sides; a plurality of reflectors disposed in the container, one along each side thereof; and a photoflash lamp disposed in operative relationship with respect to each of the reflectors. Percussive-type lamps are employed in multilamp cubical units having respective preenergized striker springs for each lamp as described in U.S. Pat. No. 3,597,604.

The light output of a flashlamp is directly related to the quantity of oxygen contained in the lamp; hence, the reduction of lamp size has been paralleled by increasing oxygen fill pressures. In addition, higher combustible metal fill weights are employed per unit of envelope volume. These higher internal pressures and fill weights per unit volume require stronger lamp envelopes and coatings, and stronger transparent containers for multilamp units.

One significant problem in the development of improved lamp containment systems is that the incidence of lamps that fail to contain is extremely low. Even though changes such as excess oxygen damaged glass or vapor weakening of the lamp coatings are introduced, the number of lamps required for testing, in order to get meaningful measures of relative containment with different proposed new coatings and containers, is prohibitively large.

In consideration of lamp reinforcing coatings, by way of example, it is known that coating tensile strength, impact strength, and heat distortion temperature are all significant parameters. It has been found, however, that knowledge of standard test method values for these characteristics does not permit reliable estimation of the relative containment capability of a proposed lamp coating. The problem is that tensile, impact, and thermal stressing of a lamp coating occur simultaneously and that the mechanical properties vary as a continuous function of both temperature and rate of load application. Meaningful data must come from evaluations carried out under actual operating or usage conditions. Studies of this type have previously required tests based on tens or hundreds of thousands of lamps. Even with such large test groups, the results were often not conclusive.

SUMMARY OF THE INVENTION

In view of the foregoing, it is an object of this invention to provide a test photoflash lamp for facilitating the study of lamp containment systems.

A principle object of the invention is to provide a test photoflash lamp whereby repeatable test lamp containment failures of controllable energy release can be produced to facilitate the test and development of lamp containment systems.

These and other objects, advantages and features are attained, in accordance with the invention, by disposing a quantity of a readily ignitable, hydrogen-containing substance, such as paper or sucrose within the gas-filled test lamp envelope. Such a modification has been found to controllably induce bursting of the lamps, upon ignition, to facilitate the study of lamp coating and container strength. Certain types of these test lamps do not even require the combustible metal fill to provide the desired containment failure; for example, a lamp filled only with high pressure oxygen and shredded paper will burst upon ignition.

BRIEF DESCRIPTION OF THE DRAWINGS

This invention will be more fully described hereinafter in conjunction with the accompanying drawings, in which.

DESCRIPTION OF PREFERRED EMBODIMENT

We have discovered that repeatable test lamp containment failures of controllable energy release can be produced by incorporation of a fuel into the lamp which burns in such a way as to rapidly and directly heat the gaseous oxygen therein.

During operation of a typical metal shred-filled flashlamp, the internal pressure rises to about two times the initial fill pressure. This pressure increase is a result of thermal expansion of the as-yet-unconsumed oxygen in the lamp. Surprisingly, it has been found that although the color temperature of the lamp is several thousand degrees Centigrade, the average oxygen temperature at the time of peak output is only several hundred degrees. That is attributable to lack of radiant heating of the oxygen because of its transparency, and also to the fact that as the oxygen surrounding a burning globule is heated conductively, it is also reacted and combined with the metallic fuel, thereby removing the hottest oxygen from the gas phase.

In direct contrast it has been found that fuels such as, for example, hydrocarbons that burn in a gas phase heat the oxygen and cause internal pressure peaks far in excess of those found with the vastly more energetic metallic fuels. More specifically, we find that the addition of relatively minute quantities of hydrogen-containing substance which is readily ignitable by the ignition means or ignited combustible metal in the lamp can be used to induce repeatable lamp containment failures for the test purposes mentioned herein. The ignitable hydrogen-containing substance may comprise at least one member selected from the group consisting of carbohydrates (e.g., paper or sucrose), hydrocarbons, synthetic polymers, and hydrogen gas. These substances generate steam as well as carbon monoxide and carbon dioxide upon burning; however, the small quantities required to effect such behavior indicate that thermal expansion of oxygen is the principle mechanism responsible. The relative explosiveness may be adjusted to suit test purposes by varying the quantity and type of additive.

Two preferred hydrogen-containing additives are sucrose and finely shredded paper. A droplet of sucrose solution may be dried inside the lamp as a spot on the envelope wall. Alternatively, paper shreds may be introduced into the lamp along with the metallic combustible. The quantity required may range from 0.1 to 25 milligrams per cubic centimeter of envelope volume.

The teachings of the invention are applicable for testing either percussive or electrically ignited photoflash lamps of a wide variety of sizes and shapes; however, it is particularly useful with respect to flashlamps having tubular shaped envelopes with a volume of less than 1 cubic centimter (cc.). Accordingly, FIGS. 1 and 2 respectively illustrate electrically ignited and percussive-type photoflash lamps embodying the principles of the invention.

Figure 1:
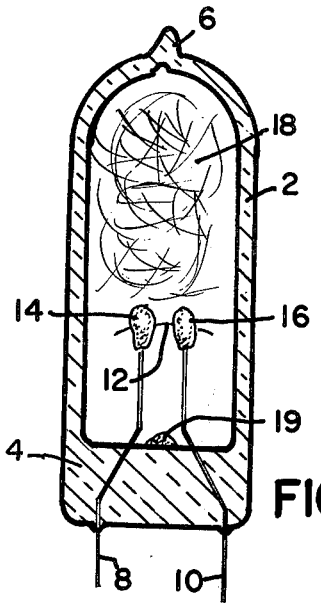
FIG. 1 is an enlarged sectional elevation of an electrically ignitable photoflash lamp containing a spot of sucrose in accordance with the invention.

Referring to FIG. 1, the electrically ignitable lamp comprises an hermetically sealed lamp envelope 2 of glass tubing having a press 4 defining one end thereof and an exhaust tip 6 defining the other end thereof. Supported by the press 4 is an ignition means comprising a pair of lead-in wires 8 and 10 extending through and sealed into the press. A filament 12 spans the inner ends of the lead-in wires, and beads of primer 14 and 16 are located on the inner ends of the lead-in wires 8 and 10, respectively, at their junction with the filament. Typically, the lamp envelope 2 has an internal diameter of less than one-half inch, and an internal volume of less than 1 cc., although the present invention is equally suitable for application to larger lamp sizes. The exterior surface of the glass envelope is covered with a protective coating such as cellulose acetate lacquer. A combustion-supporting gas, such as oxygen, and a filamentary combustible metal 18, such as shredded zirconium or hafnium foil, are disposed within the lamp envelope. Typically, the combustion-supporting gas fill is at a pressure exceeding one atmosphere, with the more recent subminiature lamp types having oxygen fill pressures of up to several atmospheres. In accordance with the invention, the lamp envelope also contains a quantity of sucrose 19 disposed as a spot on the inside wall of envelope 2 at the base portion between the filament lead-in wires. The typical quantity of sucrose employed is from about 5 to 15 mgs. per cubic centimeter of envelope volume.

Figure 2:
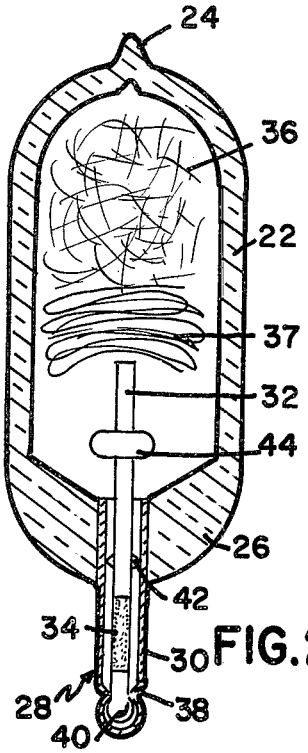
FIG. 2 is an enlarged sectional elevation of a percussive-type photoflash lamp containing paper shreds in accordance with the invention; and, FIG. 3 shows plots of internal lamp pressure versus time for two similar lamps, one with and one without sucrose in accordance with the invention.

The percussive-photoflash lamp illustrated in FIG. 2 comprises a length of glass tubing defining an hermetically sealed lamp envelope 22 constricted at one end to define an exhaust tip 24 and shaped to define a seal 26 about a primer 28 at the other end thereof. The primer 28 comprises a metal tube 30, a wire anvil 32, and a charge of fulminating material 34. A combustible metal 36, such as filamentary zirconium or hafnium, and a combustion-supporting gas, such as oxygen, are disposed within the lamp envelope, with the fill gas being at a pressure of greater than one atmosphere. The exterior surface of the glass envelope is covered with a protective coating, such as cellulose acetate lacquer. In accordance with the invention, the lamp also contains a quantity of shredded paper 37 disposed in the envelope between the filamentary combustible metal 36 and the primer 28. The typical quantity of paper employed is from about 1 to 10 mgs. per cubic centimeter of envelope volume. In the manufacture of the lamp, the paper is inserted first, then the metal shreds are blown into the lamp bottle. This prevents the paper from being burned by the heat applied in constricting and tipping off the envelope at 24.

The wire anvil 32 is centered within the tube 30 and is held in place by a circumferential indenture 38 of the tube 30 which loops over the head 40, or other suitable protuberance, at the lower extremity of the wire anvil. Additional means, such as lobes 42 on wire anvil 32 for example, may also be used in stabilizing the wire anvil, supporting it substantially coaxial within the primer tube 30 and insuring clearance between the fulminating material 34 and the inside wall of tube 30. A refractory or metal bead 44 is located on the wire anvil 32 just above the inner mouth of the primer tube 30 to eliminate tube 30 burn-through and function as a deflector to deflect and control the ejection of hot gases from the fulminating material in the primer. The lamp of FIG. 2 is also typically a subminiature type having envelope dimensions similar to those described with respect to FIG. 1.

Although the lamp of FIG. 1 is electrically ignited, usually from a battery source, and the lamp of FIG. 2 is percussion-ignitable, the lamps are similar in that in each the ignition means is attached to one end of the lamp envelope and disposed in operative relationship with respect to the filamentary combustible metal 18 or 36. More specifically, the igniter filament 12 of the flash lamp in FIG. 1 is incandesced electrically by current passing through the metal filament support leads 8 and 10, whereupon the incandescent filament 12 ignites the beads of primer 14 and 16 which in turn ignite the combustible metal 18 disposed within the lamp envelope. The ignited combustible metal then ignites the sucrose 19. Operation of the percussive-type lamp of FIG. 2 is initiated by an impact onto tube 30 to cause deflagration of the fulminating material 34 up though the tube 30 to ignite the shredded paper 37 and combustible metal 36 disposed within the lamp envelope.

Figure 3:
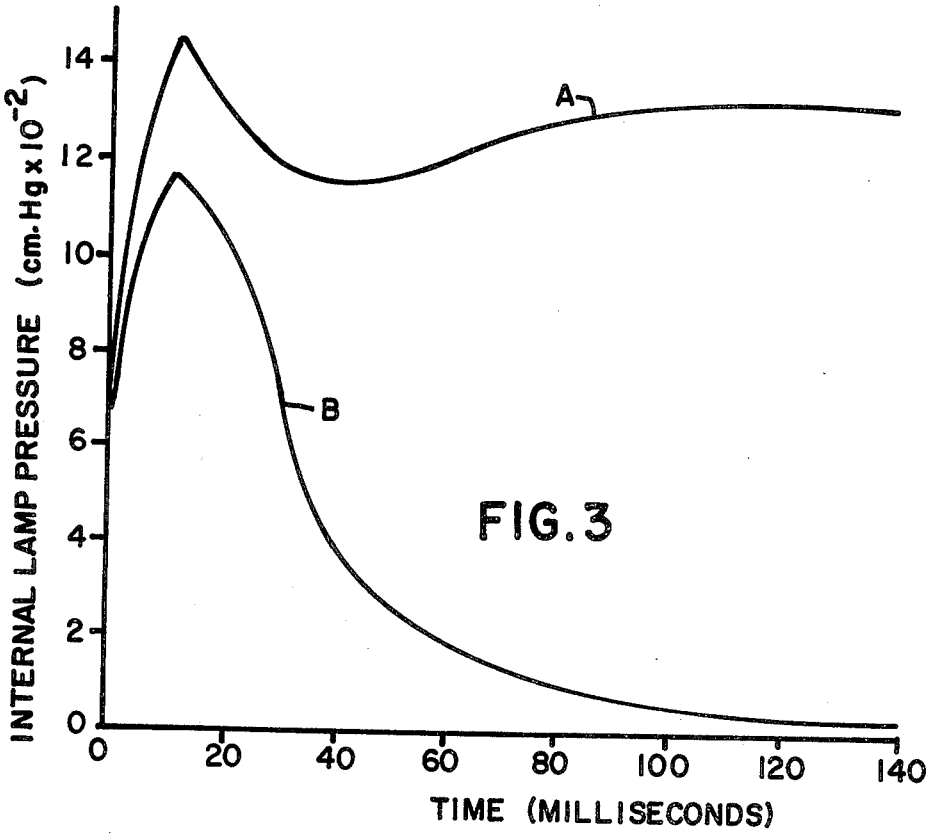

In one typical embodiment of the invention, electrically ignitable flashlamps, having an internal envelope volume of 0.78 cc., were each modified by the disposition of a dried spot of approximately 8 mgs. of sucrose 19 on the inside wall, as shown in FIG. 1. Each lamp was loaded with 30 mgs. of shredded zirconium foil comprising 0.286 inch strands having a cross-section of 0.95 × 1.3 mils. The tubular lamps had an outside diameter of 0.4 inch and, when finished, contained an initial oxygen fill prssure of 650 cm. Hg. Upon ignition, these sucrose modified lamps exhibited the average internal pressure vs. time characteristic represented by curve A of FIG. 3. For comparison, curve B represents the average internal lamp pressure over a period of time from the point of ignition to about 140 milliseconds after ignition for the same type of lamps without the sucrose additive. These curves show that the sucrose additive causes the peak pressure to increase slightly and significantly extends the high internal pressure over a much longer time interval. In lamps of this type (i.e., curve A), failure occurs late in the flash cycle after the lamp protective coating has had time to be heated by the flash. Internal pressure is maintained until the vessel fails though cracking of the glass and thermal weakening of the coating.

Somewhat in contrast is the apparent behavior of lamps modified with shredded paper. In this case, a very high pressure occurs in a relatively short time period and the vessel fails much earlier through pressure overload. The plastic protective coating on paper-shred-modified lamps shows no evidence of softening, but rather is torn or shattered by mechanical processes. Such test lamps are particularly useful in the evaluation of the transparent covers for flashcubes or arrays.

In a typical embodiment of a paper modified, percussive flashlamp, a tubular lamp envelope having an outside diameter of 0.350 inch and an internal volume of 0.68 cc. was loaded with 18 mgs. of shredded zirconium foil comprising 4 inch strands having a cross section of 0.95 × 1.3 mils and contained an initial oxygen fill pressure of 550 cm. Hg. Approximately 1½ milligrams of shredded paper 37 was located between the combustible metal 36 and primer 28 (FIG. 2). The desired test results were achieved with 3 mil thick paper having a shred width of about 10 mils and a shred length of about 5 inches. We observed that explosiveness can be controlled somewhat by varying the weight and size, or coarseness, of the paper shreds. For example, paper shreds having a width of 19 mils were slower burning and exhibited a slower pressure peak than the 10 mil shreds.

Although the invention has been described with respect to specific embodiments, it will be appreciated that modifications and changes may be made by those skilled in the art without departing from the true spirit and scope of the invention. For example, a variety of readily ignitable, hydrogen-containing substances may be employed as the additive in either a solid, liquid or gaseous state. Certain of the additives may be employed in oxygen-filled test lamps without the combustible metal fill to provide the desired containment failure; for example, a lamp filled only with shredded paper and oxygen will burst upon ignition. Further, there are many possible ways to incorporate the additive into the lamp, such as by interior coatings of particles attached to the envelope, lead-in wires, or shreds; or placement of solid particles or objects may be at various desired locations in the lamp.

What we claim is:

1. A test photoflash lamp comprising:
an hermetically sealed, light-transmitting envelope;
a combustion-supporting gas in said envelope;
a quantity of filamentary metallic combustible material located in said envelope;
ignition means attached to said envelope and disposed in operative relationship with said filamentary combustible material, said ignition means including primer material; and
a selected quantity of readily ignitable, hydrogen-containing solid fuel means located within said envelope separately from said primer material and said filamentary metallic combustible material for controllably inducing bursting of said lamp upon ignition to thereby test the relative strength and reliability of containment of said lamp.

2. A test lamp according to claim 1 wherein said hydrogen-containing fuel comprises at least one member selected from the group consisting of carbohydrates, hydrocarbons, and synthetic polymers.

3. A test lamp according to claim 1 wherein said combustion-supporting gas comprises oxygen.

4. A test lamp according to claim 1 wherein the quantity of said hydrogen-containing fuel per unit of envelope volume is from about 0.1 to 25 milligrams per cubic centimeter.

5. A test photoflash lamp comprising:
an hermetically sealed, light-transmitting envelope;
a combustion-supporting gas in said envelope;
ignition means including a primer material attached to said envelope; and
a selected means including quantity of readily ignitable paper located within said envelope for controllably inducing bursting of said lamp upon ignition to thereby test the relative strength and reliability of containment of said lamp.

6. A test lamp according to claim 5 wherein the quantity of said paper per unit of envelope volume is from about 0.1 to 25 milligrams per cubic centimeter.

7. A test lamp according to claim 5 wherein said paper is shredded.

8. A test lamp according to claim 7 further including a quantity of filamentary combustible metal located within said envelope, and wherein said gas comprises oxygen, said ignition means is disposed in operative relationship with respect to said combustible metal, and said paper is readily ignitable by said ignition means or by ignited combustible metal in said lamp.

9. A test lamp according to claim 8 wherein the quantity of said paper per unit of envelope volume is from about 1 to 10 milligrams per cubic centimeter.

10. A test photoflash lamp comprising:
an hermetically sealed light-transmitting envelope;
a combustion-supporting gas in said envelope;
a quantity of combustible metal located within said envelope;
ignition means attached to said envelope and disposed in operative relationship to said combustible metal; and
a selected quantity of sucrose readily ignitable by ignited combustible metal in said lamp and located within said envelope for controllably inducing bursting of said lamp upon ignition to thereby test the relative strength and reliability of containment of said lamp.

11. A test lamp according to claim 10 wherein said sucrose is disposed as a spot on the inside wall of said envelope.

12. A test lamp according to claim 10 wherein the quantity of said sucrose per unit of envelope volume is from about 0.1 to 25 milligrams per cubic centimeter.

13. A test lamp according to claim 12 wherein said combustion-supporting gas comprises oxygen, and the quantity of said sucrose per unit of envelope volume is from about 5 to 15 milligrams per cubic centimeter.

* * * * *